US011802415B2

(12) United States Patent
Ramirez et al.

(10) Patent No.: US 11,802,415 B2
(45) Date of Patent: Oct. 31, 2023

(54) CONTINUOUS COMPOSITE STRUCTURAL REINFORCING DEVICE AND SYSTEM

(71) Applicant: JXR Constructors, Inc., San Diego, CA (US)

(72) Inventors: Jesus Ramirez, San Diego, CA (US); Victor Reyes, San Diego, CA (US)

(73) Assignee: JXR CONSTRUCTORS, INC., San Diego, CA (US)

( * ) Notice: Subject to any disclaimer, the term of this patent is extended or adjusted under 35 U.S.C. 154(b) by 0 days.

(21) Appl. No.: 17/500,668

(22) Filed: Oct. 13, 2021

(65) Prior Publication Data

US 2022/0120104 A1 Apr. 21, 2022

Related U.S. Application Data

(60) Provisional application No. 63/093,126, filed on Oct. 16, 2020.

(51) Int. Cl.
*E04G 23/02* (2006.01)
*E04C 5/07* (2006.01)

(52) U.S. Cl.
CPC ..... *E04G 23/0244* (2013.01); *E04C 5/07* (2013.01); *E04C 5/073* (2013.01); *E04G 23/0229* (2013.01); *E04G 2023/0262* (2013.01)

(58) Field of Classification Search
CPC ..... E04C 5/07; E04C 5/073; E04G 23/0244; E04G 23/0229; E04G 2023/0251; E04G 2023/0262
See application file for complete search history.

(56) References Cited

U.S. PATENT DOCUMENTS 6,468,613 B1 10/2002 Kitano et al.
7,799,154 B2 9/2010 Wu
9,010,047 B2 4/2015 Wu
9,290,957 B1 * 3/2016 Wheatley ..... E04G 23/0222
9,567,675 B2 2/2017 Naritomi
(Continued)

FOREIGN PATENT DOCUMENTS

EP 2021404 2/2009
JP H08144541 A * 6/1996
(Continued)

OTHER PUBLICATIONS

International Search Report for PCT/US2021/054824 dated Oct. 13, 2021.
(Continued)

*Primary Examiner* — Jessie T Fonseca
(74) *Attorney, Agent, or Firm* — Ying-Ting Chen

(57) ABSTRACT

A pre-fabricated composite reinforcement device for installation on a structure, comprising a metal reinforcement layer; a fiber reinforced polymer layer; an adhesive layer configured between the metal and fiber reinforced polymer layer; and a plurality of power-actuated fasteners configured for securing the metal reinforcement, fiber reinforced polymer, and adhesive layer to the structure; and wherein a first side of the metal reinforcement layer is for positioning upon the structure for installation of the fasteners with the first side facing away from the structure, and a second side is configured with the adhesive and fiber reinforced layer across a surface area of the second side of the metal reinforcement layer.

18 Claims, 11 Drawing Sheets

(56) References Cited

U.S. PATENT DOCUMENTS

| | | | | |
|---|---|---|---|---|
| 9,719,255 | B1 | 8/2017 | Ehsani | |
| 10,385,238 | B2 | 8/2019 | Kishimoto | |
| 2005/0175813 | A1 | 8/2005 | Wingert | |
| 2006/0257624 | A1 | 11/2006 | Naritomi | |
| 2008/0000571 | A1* | 1/2008 | Wu | E04C 5/07 156/307.7 |
| 2010/0189957 | A1 | 7/2010 | Naritomi | |
| 2013/0008111 | A1* | 1/2013 | Wu | E04G 23/0218 52/831 |
| 2014/0205800 | A1 | 7/2014 | Raghavendran et al. | |
| 2016/0258173 | A1* | 9/2016 | Wheatley | E02D 31/10 |
| 2020/0277786 | A1 | 9/2020 | Biskup | |
| 2020/0316915 | A1 | 10/2020 | Ibaragi et al. | |

FOREIGN PATENT DOCUMENTS

| | | | | |
|---|---|---|---|---|
| JP | H10121745 | A | * | 5/1998 |
| JP | 2010208287 | | | 9/2010 |
| JP | 5295741 | | | 9/2013 |
| JP | 5554483 | | | 7/2014 |
| JP | 2019-196603 | | | 11/2019 |
| KR | 20120010306 | A | * | 2/2012 |
| KR | 101166216 | B1 | * | 7/2012 |
| KR | 20160149869 | A | * | 12/2016 |

OTHER PUBLICATIONS

Grelle, S. V., and Sneed, L. H. Review of Anchorage Systems for Externally Bonded FRP Laminates. International Journal of Concrete Structures and Materials. vol. 7, Issue 1, Mar. 2013. Retrieved from https://doi.org/10.1007/s40069-013-0029-0.

* cited by examiner

CONTINUOUS COMPOSITE STRUCTURAL REINFORCING DEVICE AND SYSTEM

PRIORITY CLAIM

This application claims the priority date of provisional application No. 63/093,126 filed on Oct. 16, 2020, which is herein incorporated by reference in its entirety.

BACKGROUND

The present disclosure relates generally to a continuous composite structural reinforcing device and system for structural retrofitting across the face or length of structural elements, such as a beams, walls, slabs, and other structural elements. Older buildings/structures, were typically built according to outdated codes and specifications and no longer have adequate capacity to meet current needs or uses as well as other environmental factors. For example, older buildings built of concrete are found not to have enough rebar therewithin to meet current code requirements. While there are existing retrofit reinforcing systems for structures, they use insufficient parts, standalone parts, layering, inferior adhesion mechanisms/factors, and/or have construction costs.

Additionally, these existing reinforcing devices are typically built on-site, which leads to variation in the set-up, installation, and quality control as well as significantly increases the time, resources, and work that must be performed at a worksite. Thus, there is a need for a structural reinforcing device and system that takes advantages of multiple technologies to provide continuous uniform reinforcement along a structure with an alternate way of connecting to the existing structure. There is also a need for a continuous structural reinforcing device and system that has superior strength in retrofitting a structure, is low in weight, and eliminates current installation preparation procedures and methodologies that increase building/installation costs.

SUMMARY

The present disclosure provides a structural reinforcing device and system that takes advantages of multiple technologies to provide continuous uniform reinforcement along a structure with an alternate way of connecting to the existing structure. Further, the present disclosure also provides a continuous structural reinforcing device and system that has superior strength in retrofitting a structure, is low in weight, and eliminates current installation preparation procedures and methodologies that increase building/installation costs.

A pre-fabricated composite reinforcement device for installation on a structure, comprising a metal reinforcement layer; a fiber reinforced polymer layer; an adhesive layer configured between the metal and fiber reinforced polymer layer; and a plurality of power-actuated fasteners configured for securing the metal reinforcement, fiber reinforced polymer, and adhesive layer to the structure; and wherein a first side of the metal reinforcement layer is for positioning upon the structure for installation of the fasteners with the first side facing away from the structure, and a second side is configured with the adhesive and fiber reinforced layer across a surface area of the second side of the metal reinforcement layer.

A pre-fabricated composite reinforcement device for installation on a structure, comprising a metal reinforcement layer; a fiber reinforced polymer layer; a first adhesive layer configured between the metal and fiber reinforced polymer layer; a second adhesive layer configured between the fiber reinforced polymer layer and the structure; and a plurality of power-actuated fasteners configured for securing the metal reinforcement, fiber reinforced polymer, and adhesive layers to the structure; and wherein a first side of the metal reinforcement layer is for positioning upon the structure for installation of the fasteners with the first side facing away from the structure; and further wherein a second side of the metal reinforcement layer is configured with the first and second adhesive layers and fiber reinforced layer.

A method of pre-fabricating a composite reinforcement device for installation on a structure, comprising the steps of: pre-fabricating a metal reinforcement layer as a rectangular strip shape; pre-fabricating a unidirectional fiber reinforced polymer layer as a rectangular strip shape; positioning a first side of the metal reinforcement layer on the structure with the first side facing away from the structure; configuring attachment of a first side of the fiber reinforced polymer layer atop a second side of the metal reinforcement layer with an adhesive layer therebetween; wherein a second side of the fiber reinforced polymer layer is laid upon the structure itself; wherein a plurality of power-actuated fasteners are configured for securing the metal reinforcement, fiber reinforced polymer, and adhesive layer to the structure via entry atop the first side of the metal reinforcement layer.

DESCRIPTION OF THE PREFERRED EMBODIMENTS

The detailed descriptions set forth below are intended as a description of embodiments of the invention, and are not intended to represent the only forms in which the present invention may be constructed and/or utilized. The descriptions set forth the structure and the sequence of steps for constructing and operating the invention. It is to be understood, however, that the same or equivalent structures and steps may be accomplished by different embodiments that are also intended to be encompassed within the spirit and scope of the invention.

Figure 1A:
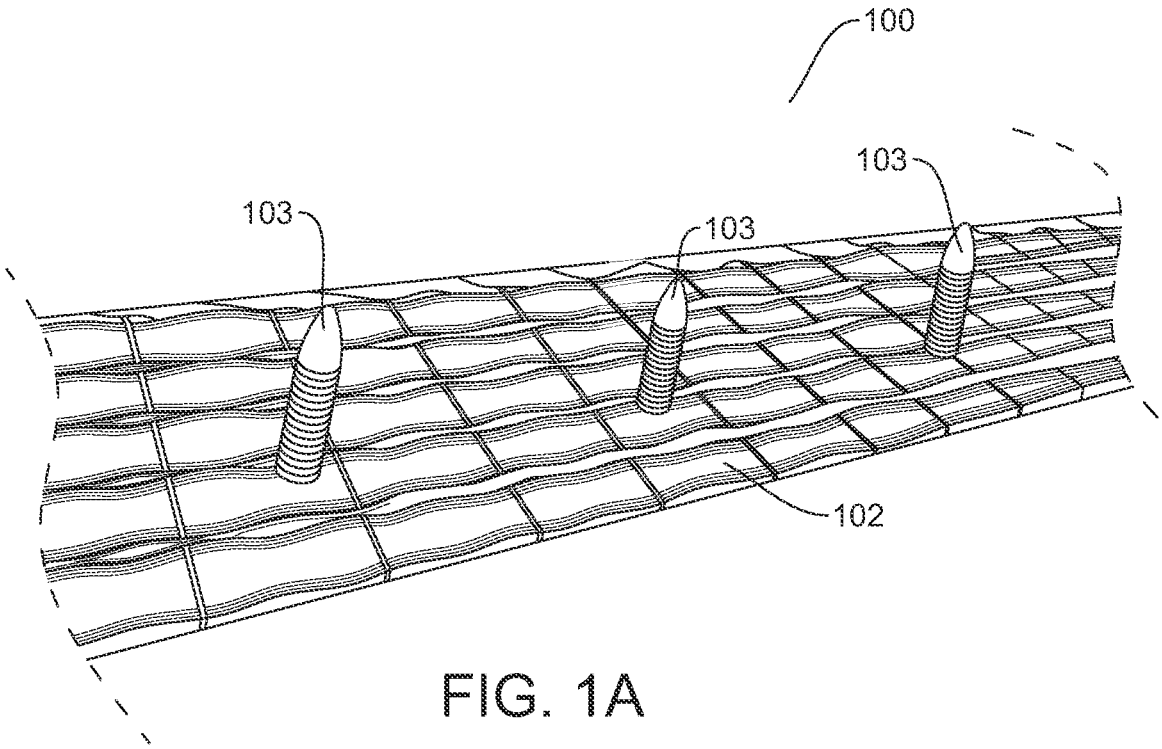
FIGS. 1(A) and (B) depict perspective views of each side of a continuous composite structural reinforcing device.
Figure 1B:
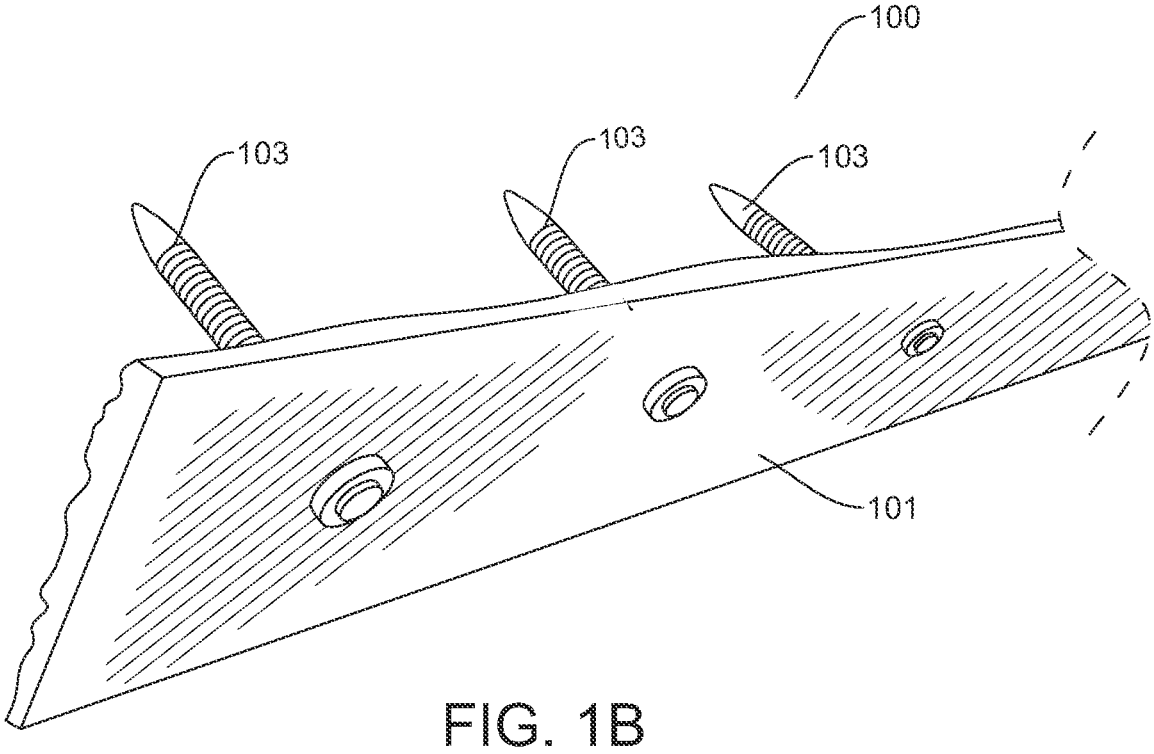

FIGS. 1(A) and (B) depict perspective views of each side of a continuous composite structural support/reinforcing device 100, namely a steel plate side or layer 101 and a fiber reinforced polymer (hereinafter, "FRP") plate or layer 102. FIGS. 1(A) and (B) also depict a plurality of mechanical anchors or fasteners 103 (further discussed below). The continuous composite structural reinforcing device 100 may be used in a singular arrangement, or in the exemplary embodiment, with a plurality of devices 100 in a strategically placed configuration on a structure to serve as an external reinforcement system (See FIG. 2(A) for an illustration of the same). The reinforcing device 100 can provide external tensile reinforcement to structures, particularly concrete structures and elements that are aging, built according to inferior or outdated building requirements, or slated for change of use (e.g., addition of a rooftop garden).

In the exemplary embodiment, structural reinforcing device 100 is prefabricated through a manufacturing process prior to bringing it onsite for use/installation (such pre-fabrication stage/process referred to as bracket labeled as 100A and an installation stage/process referred to as in the brackets labeled 100B (See FIG. 7 for further details)). By pre-fabrication 100A of structural reinforcing device 100, this allows a user, such as a construction worker, to bypass additional installation methods/steps and avoid inconsistent layering and/or installation methods. As indicated above, the continuous composite structural reinforcing device 100 may be comprised of metal or steel plate layer 101 and FRP layer 102. In an exemplary embodiment, steel layer 101 may be comprised of a thin steel sheet, such as a light gauge steel strip, and is utilized for its properties relating to a fine finish, weldability, light weight, ductility, high tensile and yield strength, and ability to maintain its form without shrinkage or changing form or appearance.

Figure 3A:
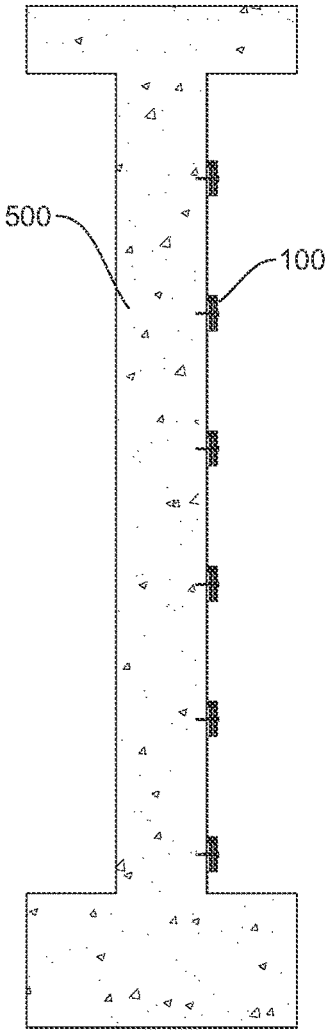
FIGS. 3(A) and 3(B) are cross-sectional views of the continuous composite structural reinforcing device installed as a system on a wall structure and in a standalone view.
Figure 3B:
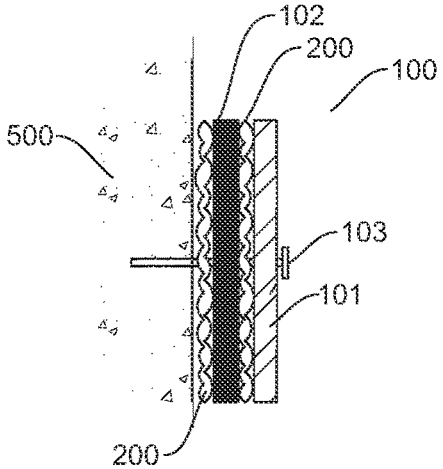

In a manufacturing/pre-fabrication stage/process (See brackets 100A in FIG. 7) of the continuous composite structural reinforcing device 100, FRP layer 102 may be bonded to steel plate layer 101 through the use of a composite adhesive layer 200 (not shown) (See FIG. 3(B) for an illustration thereof). The composite adhesive layer 200 may be comprised of an epoxy material. However, other comparable adhesives may be utilized without deviating from the scope of the present invention. Once the steel plate layer 101 and FRP layer 102 are initially bonded through use of the composite adhesive layer 200, such layering of the structural reinforcing device 100 is allowed to cure before any shipment or delivery to an installation site. In an exemplary embodiment, FRP layer 102 is configured or assembled to cover the entire area/surface of one side of the steel plate 101.

In an exemplary embodiment, the composite structural reinforcing device 100 is manufactured as rectangular pieces or strips, and with dimensions in the range of at least approximately 1 feet in length and at 1 inch to 12 inch in width. In an exemplary embodiment of the continuous composite structural reinforcing device 100 for retrofitting a structure, it is manufactured in the range of 1-100 feet in length.

Figure 2A:
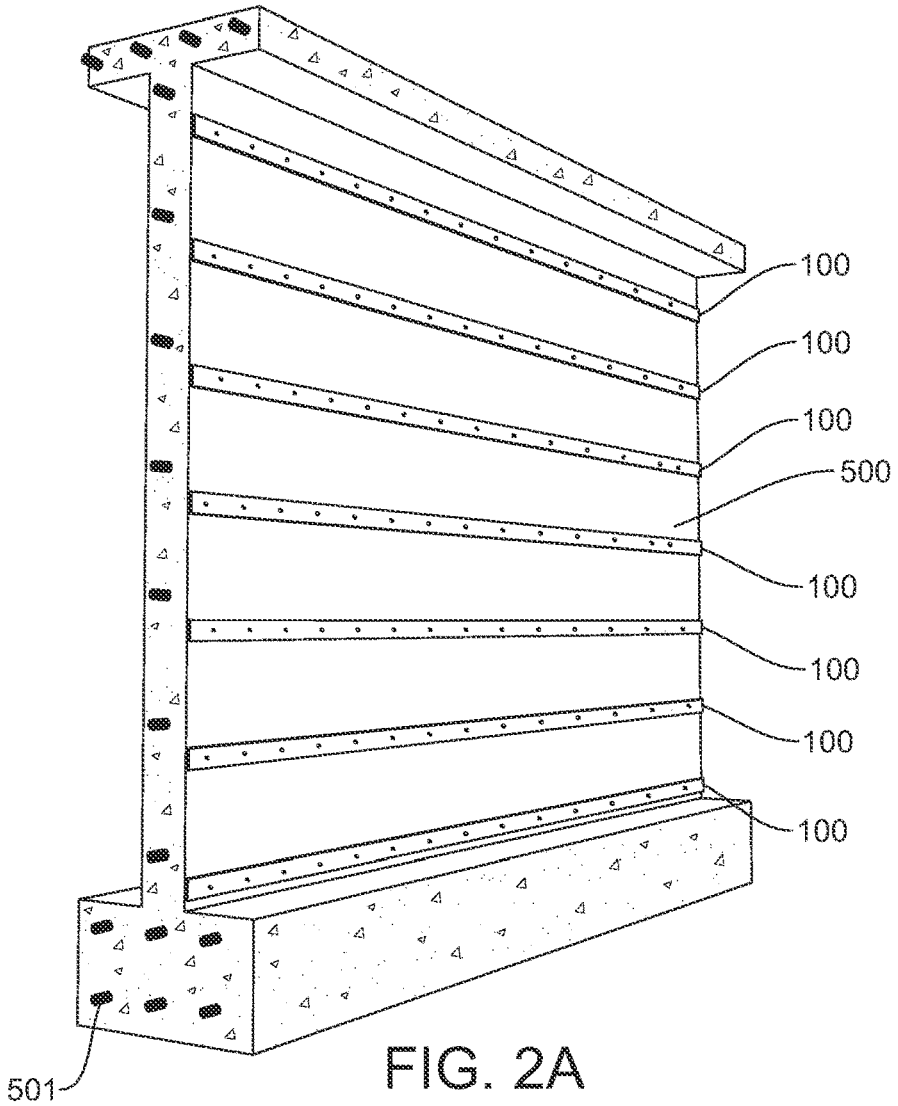
FIGS. 2(A) and (B) are perspective views of the continuous composite structural reinforcing device installed as a system on a wall structure and a beam structure, respectively.

FIGS. 2(A) and (B) are perspective views of the continuous composite structural reinforcing device 100 installed as a system on a wall structure 500 and a beam structure 600, respectively. In particular, these figures illustrate how the composite structural reinforcing device 100 is strategically placed and externally bonded across the length of a concrete structure. As is often found in older concrete structures, there are insufficient rebar and/or internal structural strengthening elements used therein. The composite structural reinforcing device 100 is able to provide a continuous line of external strengthening reinforcement across a surface of the structure as shown here. In the example shown in FIG. 2(A), a plurality of composite structural reinforcing devices 100 are installed in a horizontal configuration with each device 100 placed with a space in between devices 100 running parallel to the existing rebar 501 that runs internally within the structure 500. In an exemplary installation, placement of the composite structural reinforcing device 100 applied to substrate running parallel to each rebar 501 may provide an enhanced and superior level of external tensile reinforcement to the structure 500. Composite structural reinforcing device 100 may be applied in an alternate configuration on structure 500, which may depend in part on the composition of the underlying structural reinforcing elements. Composite structural reinforcing device 100 may also be applied to other types of structures, including concrete slabs, timber, and steel beams, and is scalable according to the size and structural reinforcing needs/requirements of a structure, or other edifice.

Figure 2B:
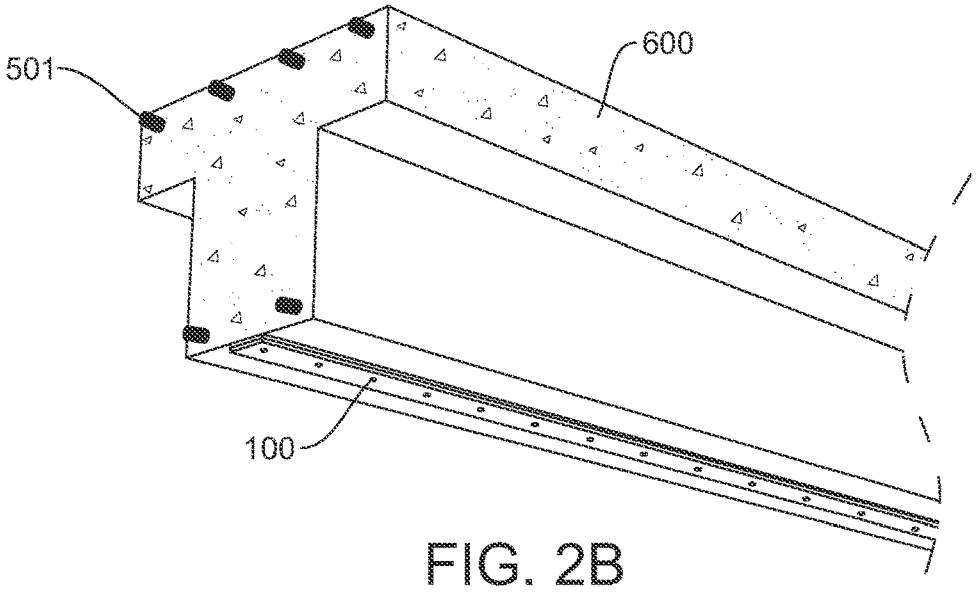
Figure 3C:
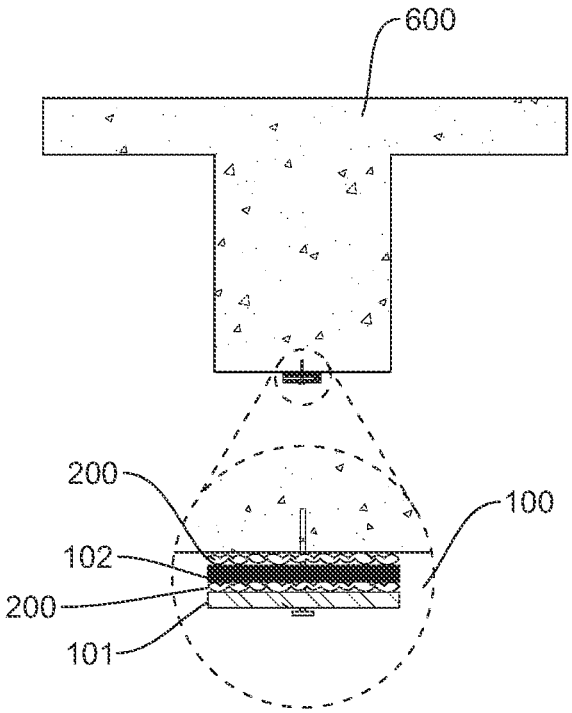
FIG. 3(C) is a cross-sectional view of the continuous composite structural reinforcing device layering when installed on the beam structure.

FIGS. 3(A) and 3(C) are cross-sectional views of the composite structural reinforcing device 100 installed as a system on the wall structure 500 shown in FIG. 2(A) and the beam structure 600 shown in FIG. 2(B), respectively. FIG. 3(B) is a close-up cross-section view of the composite structural reinforcing device 100 layering as installed on the wall structure 500. FIG. 3(A) depicts how composite structural reinforcing device 100 may be placed in a strategic reinforcing configuration across the face of wall structure 500.

The cross-sectional view of FIG. 3(B) depicts further detail of the composite structural reinforcing device 100, including adhesive layer 200 between device 100 and the wall structure 500. As mentioned above, adhesive layer 200 may comprise an epoxy material. In installation of the composite structural reinforcing device 100, a user may apply a thin coat of epoxy, such as a thickened epoxy material, on a concrete surface (such as wall structure 500) so as to serve as a tack coat layer for the composite structural reinforcing device 100. Then the user would apply the pre-fabricated composite structural reinforcing device 100 to such epoxy layer (or adhesive layer 200), including by pressing it against the epoxy adhesive layer 200 and ensuring it stays in place until the epoxy layer hardens and/or dries. Installation (See brackets 100B in FIG. 7) of device 100 may include or exclude adhesive layer 200 depending on the specific application requirements and/or the installation site.

An advantage of the present device and system is that a user does not have to grind or otherwise provide surface preparation for installation of the composite structural reinforcing device 100. In an installation site, such as a construction worksite, it is typical for a worker to have to grind or blast concrete for structural reinforcing retrofitting (and other activities), including carbon adhesion of the epoxy to the concrete surface. Grinding or blasting concrete creates a dust byproduct, including silica dust (concrete dust), which is particularly harmful to one inhaling the same. By avoiding any grinding or concrete blasting, it increases the overall efficiency by eliminating surface preparation and the costs of large equipment commonly used in such installations/construction work as well as reduces a user's risk to adverse elements and/or byproducts of the work environment.

Once the adhesive layer 200 and the composite structural reinforcing device 100 are adhered together, a user would then apply a plurality of mechanical anchors or fasteners 103 in a configuration across the length of the composite structural reinforcing device 100. Each mechanical fastener 103 may be installed through composite structural reinforcing device 100 via indicated locations 104 on the steel layer 101. Mechanical fasteners 103 may be comprised of power-actuated fasteners, such as nails (including concrete nails), and coupled through the composite structural reinforcing device 100 and to wall structure 500 through the use of a power-actuated tool. However, other post installed anchors, such as bolts, screws (including concrete screws), wedge anchors, and pegs may be used to further anchor the composite structural reinforcing device 100 to wall structure 500 or other structural surface without deviating in scope from the exemplary embodiment.

Use of mechanical fasteners 103 with the composite structural reinforcing device 100 enables an enhanced and deeper level of adhesion of the composite structural reinforcing device 100 to a structure. Further, steel layer 101 can act as a protection layer or as a "bonded washer" layer for FRP layer 102 when applying mechanical fasteners 103 through the composite structural reinforcing device 100 so as to prevent ripping, splitting, or other damage to the FRP layer 102. Due to its ductile characteristics, steel layer 101 can also provide a ductility feature or system to eliminate bearing limitations of FRP layer 102. Further, the adhesive layers 200 between steel layer 101 and FRP layer 102 as well as between FRP layer 102 and wall structure 500 provide stability to the structure/fibers of FRP layer 102 to avoid minimal, if any, detachment from the structure as well as ripping, splitting, or damage to the fibers of FRP layer 102. In another embodiment, where the adhesive layer 200 between composite structural reinforcing device 100 and structure 500 is not utilized in certain applications, such embodiment may provide an alternate level of flexibility of the installation and connection of device 100 to structure 500 (via bonded points/areas where mechanical fasteners 103 are installed) as well as decreased installation time.

In some embodiments, the overall strength or capacity of the system of composite structural reinforcing devices 100 is governed by steel layer 101 dictating the load transfer between FRP layer 102 and mechanical fastener 103; steel layer 101 dictating overall ductility capacities; and the mechanical fasteners 103 dictating load transfer between steel layer 101 and the wall structure 500, or other structure. The composite structural reinforcing device 100 may also have a higher tolerance to ripping, splitting, and/or slippage due to adhesion of steel layer 101 to FRP layer 102.

Figure 3D:
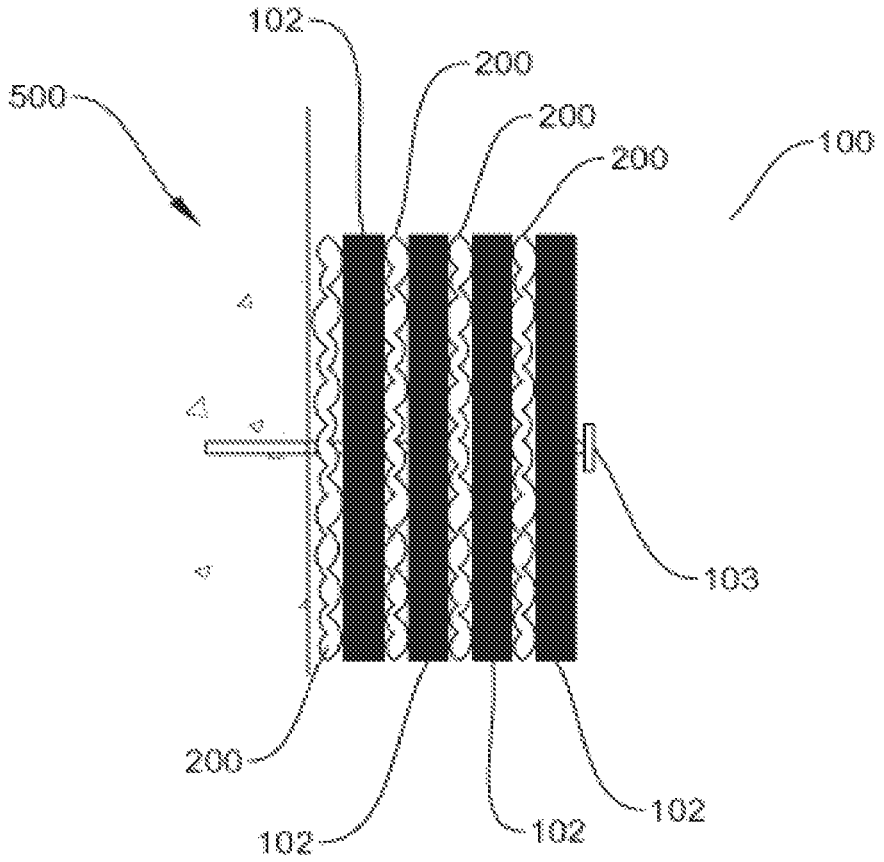
FIG. 3(D) is a cross-sectional view of the continuous composite structural reinforcing device depicting multiple layering when installed on a beam structure.

FIG. 3(D) is a cross-sectional view of the composite structural reinforcing device 100 depicting multiple FRP layers 102 when installed on a beam structure 500. Also depicted are adhesive layers 200 between each FRP layer 102. Multiple FRP layers 102 may be utilized in certain applications to increase and/or further reinforce the support load of device 100.

Figure 4A:
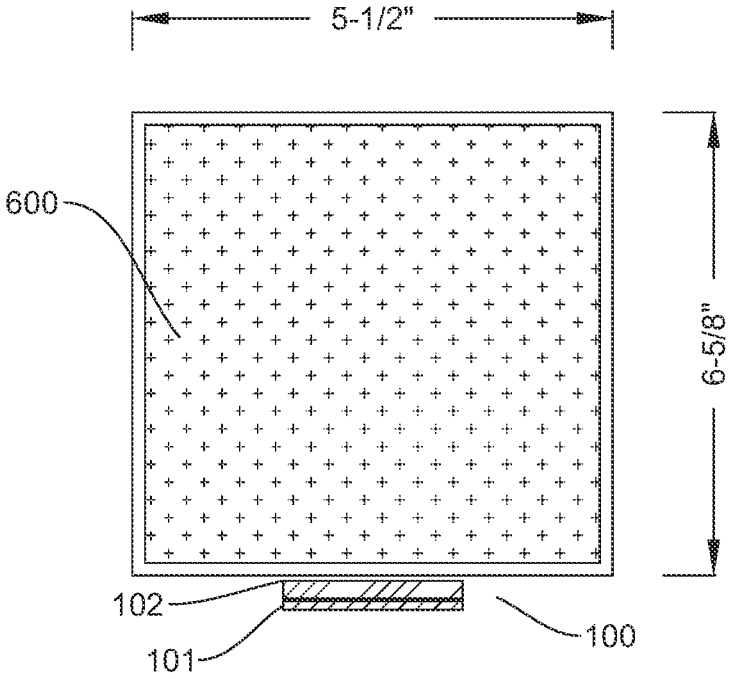
FIGS. 4(A) and (B) depict cross-sectional views of the continuous composite structural reinforcing device, including dimensions of the same.
Figure 4B:
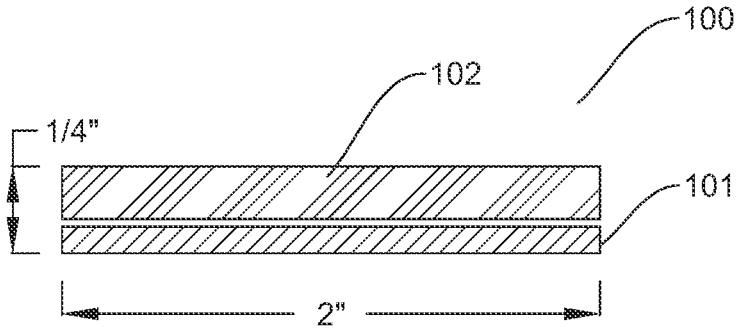

FIGS. 4(A) and (B) depict cross-sectional views of the composite structural reinforcing device 100. FIG. 4(A) further depicts one set of dimensions of a structure to which composite structural reinforcing device 100 may be installed upon. In the FIG. 4(B) view of structural reinforcing device 100, a width dimension is shown, which may be two (2) inches in an exemplary embodiment. Alternating width dimensions may be utilized therein depending on engineering needs and/or other related installation considerations. Further, the height or thickness dimensions are shown, which may be one-quarter (¼) inch measurement comprising both the steel layer 101 and FRP layer 102. Different heights or thicknesses of the composite steel 101 and FRP 102 layers may be utilized without deviating in scope from the exemplary embodiment.

Figure 5:
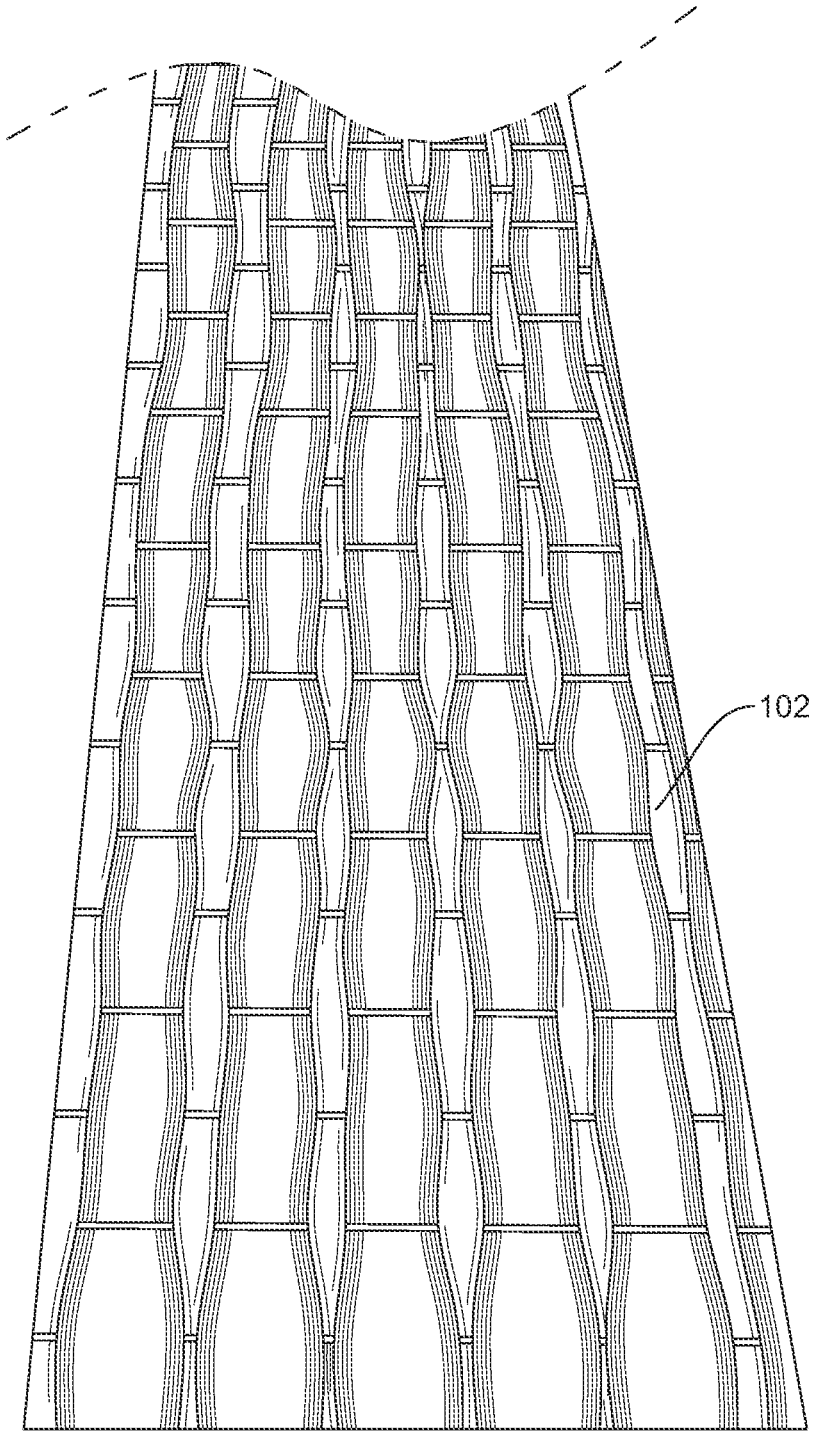
FIG. 5 depicts a front perspective view of a unidirectional fiber polymer material for use with the continuous composite structural reinforcing device and system.

FIG. 5 depicts a front perspective views of a unidirectional fiber FRP material for use with the composite structural reinforcing device 100 and system. In an exemplary embodiment, FRP layer 102 is comprised of a fiber texture/pattern that is unidirectional in nature, including as depicted in FIG. 5. A unidirectional fiber provides for a more efficient design strength by means of attachment to steel layer 101. Varying thicknesses of FRP layer 102 may be utilized, including within a range of 0.01 inches to 0.08 inches in thickness per layer, and/or multiple FRP layers 102 may be layered upon each other prior to adhesion to steel plate 101 (Also see FIG. 3(D) above). In one embodiment, FRP layer 102 may be comprised of up to eleven (11) layers of an 11 ounce per square yard FRP fabric, or in total an 88 ounce per square yard FRP fabric thickness. However, varying smaller and larger dimensions, measurements, and/or thicknesses may be utilized in connection with FRP layer 102 without deviating in scope from the present embodiment.

Figure 6:
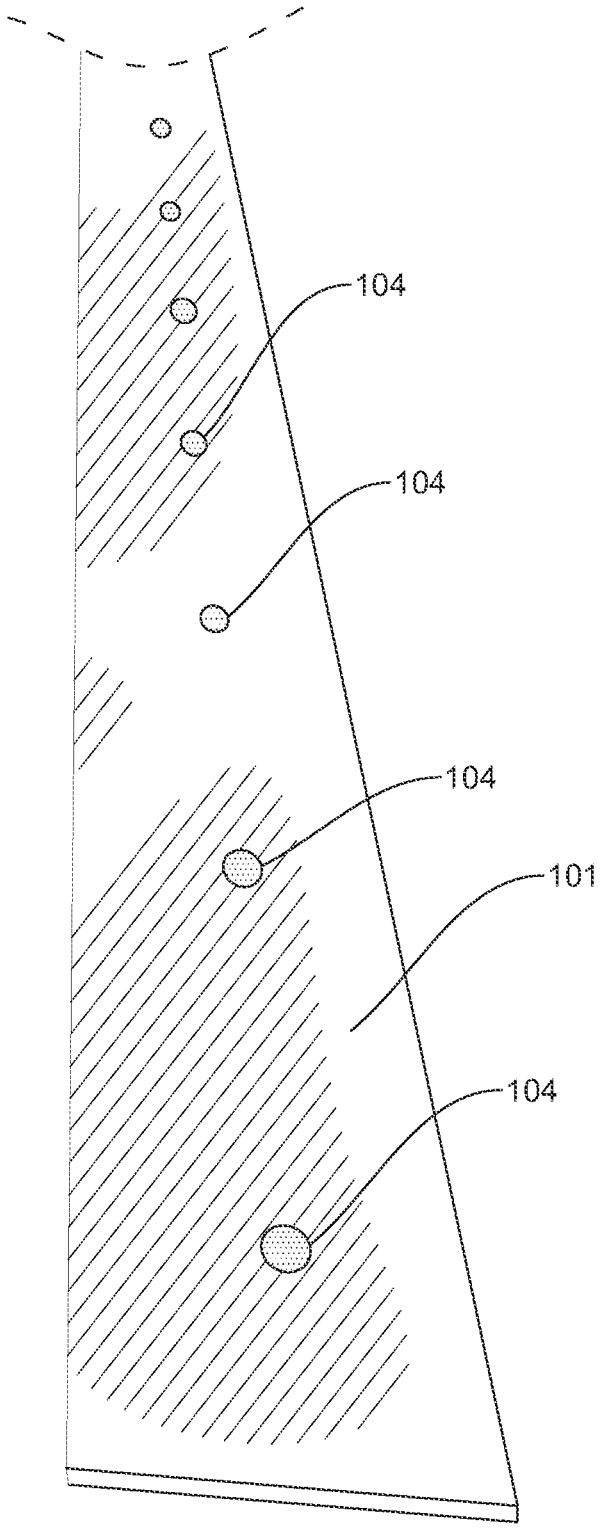
FIG. 6 depicts a front plan view of a subset of markings along a length of a steel plate layer for use with the continuous composite structural reinforcing device.

FIG. 6 depicts a front plan view of a subset of markings 104 for installation of mechanical fasteners 103 along the length of the steel layer 101 of the composite structural reinforcing device 100. As explained earlier, predetermined locations 104 may be drawn on steel layer 101 and may be circular in shape. The plurality of markings 104 may be configured in a linear configuration (including as shown in FIG. 6) or alternating positions along the steel layer's 101 length, and which may depend on engineering specifications or other related installation considerations. Steel layer 101 may be outfitted with alternate configurations and numbers of markings 104, which in another embodiment may be indicated along the opposite ends of steel layer 101.

Figure 7:
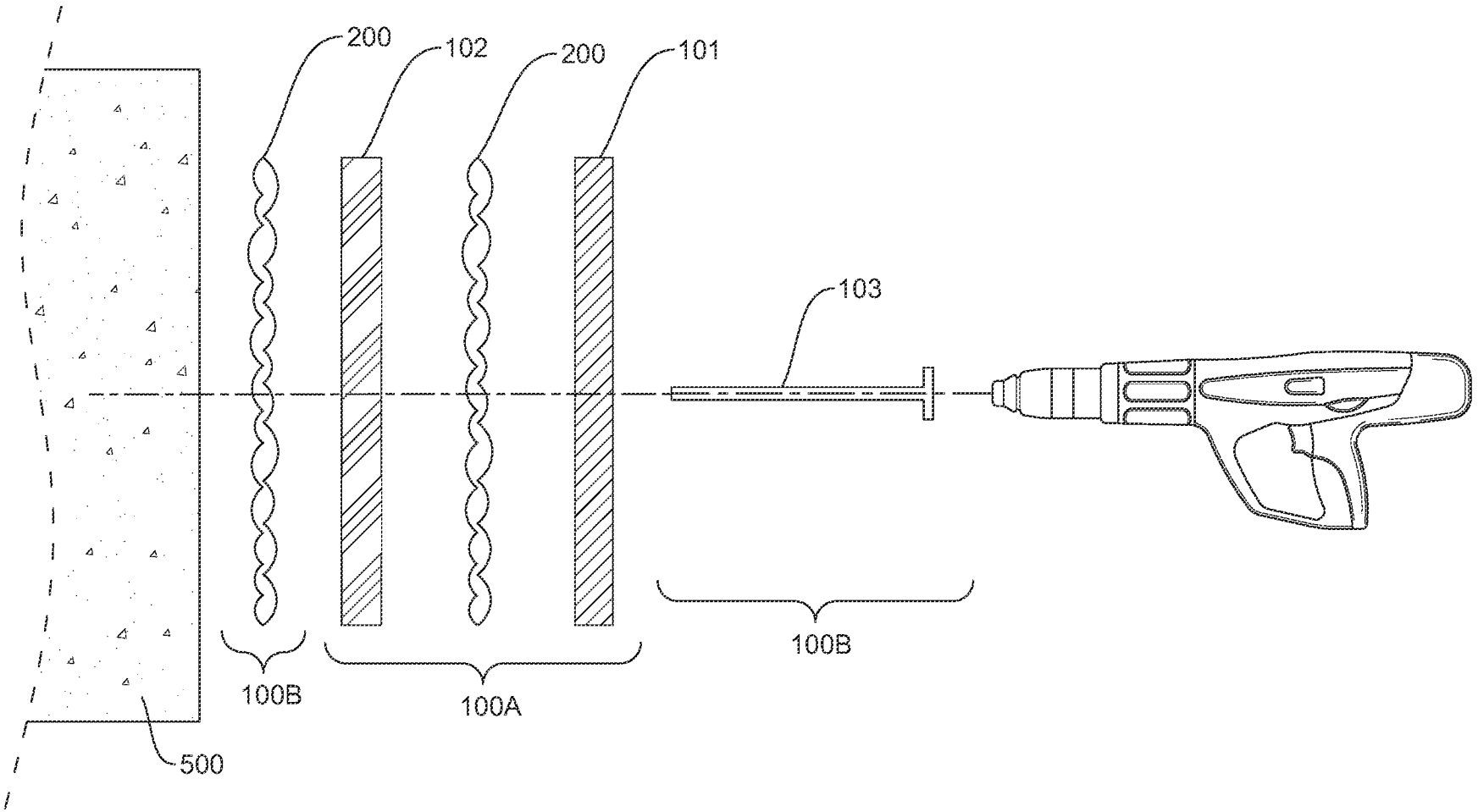
FIG. 7 depicts an exploded view of a plurality of mechanical fasteners in a direction of entry for installation onto the continuous composite structural reinforcing device.

FIG. 7 depicts an exploded view of a mechanical fastener 103 in a direction of entry for installation (See bracket 100B referring to mechanical fastener 103) onto the composite structural reinforcing device 100 (See bracket 100A depicting an exploded view of pre-fabricated device 100, namely, steel layer 101, FRP layer 102, and adhesive layer 200 therebetween) and wall structure 500 (or other structural elements) once device 100 has been connected to wall structure 500 via the adhesive layer 200 (See bracket 100B referring to adhesive layer 200). In some embodiments, the device 100 includes this second adhesive layer 200 (See bracket 100B referring to adhesive layer 200 between the wall structure 500 and the FRP layer 102) in addition to the first adhesive layer 200 (between the steel layer 101 and the FRP layer 102) (See bracket 100A).

Figure 8A:
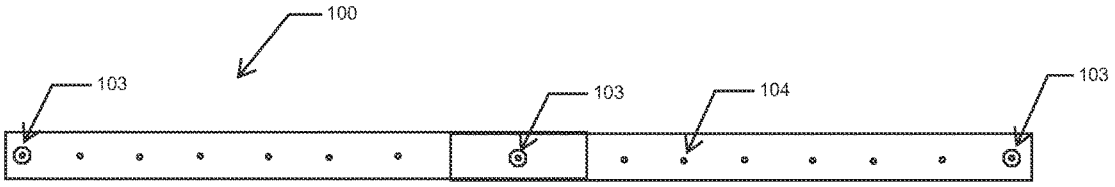
FIGS. 8(A) and (B) depict a top view and side view of the continuous structural reinforcing device in a spliced configuration.
Figure 8B:
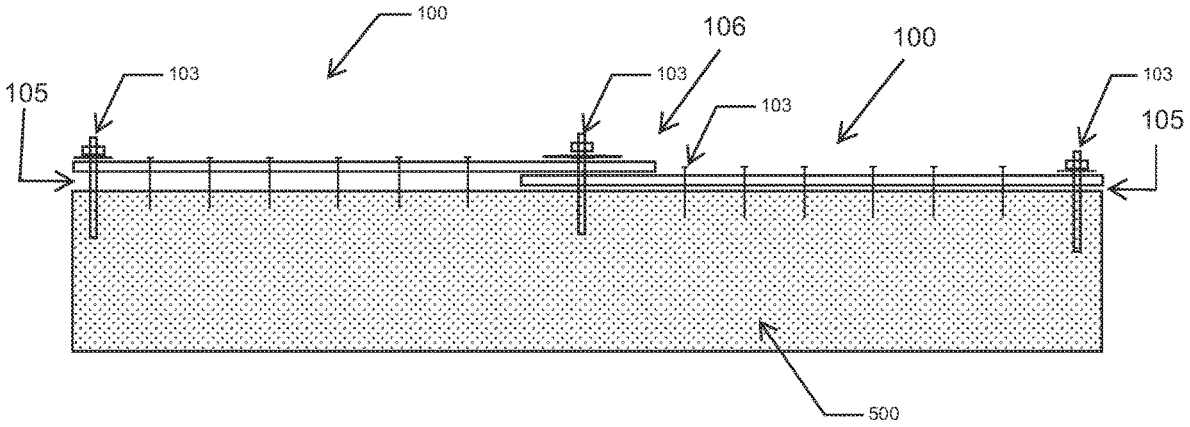

FIGS. 8(A) and (B) depict a top view and side view of the continuous structural reinforcing device 100 in a spliced configuration. A spliced configuration of device 100 may be implemented in circumstances, including when device 100 may not be long enough for the particular application or the dimensions/installation area has changed in scope. In a spliced configuration, mechanical fasteners 103 may be positioned and installed through device 100 at an overlapping seam 106 of the spliced configuration of device 100 where ends of each composite reinforcement device 100 are overlapped and as well as at the ends of each spliced piece of device 100 and as further illustrated in FIGS. 8A and 8B, wherein in the spliced configuration, a space 105 is formed between the composite structural reinforcing device 100 and the structure 500. In some embodiments, the space between two adjacent mechanical fasteners 103 are the same or spaced evenly. In other embodiments, the space between two adjacent mechanical fasteners 103 are spaced unevenly. In some other embodiments, the density of the mechanical fasteners 103 are higher in one area than the other areas (e.g., clusters of the mechanical fasteners 103).

Figure 9:
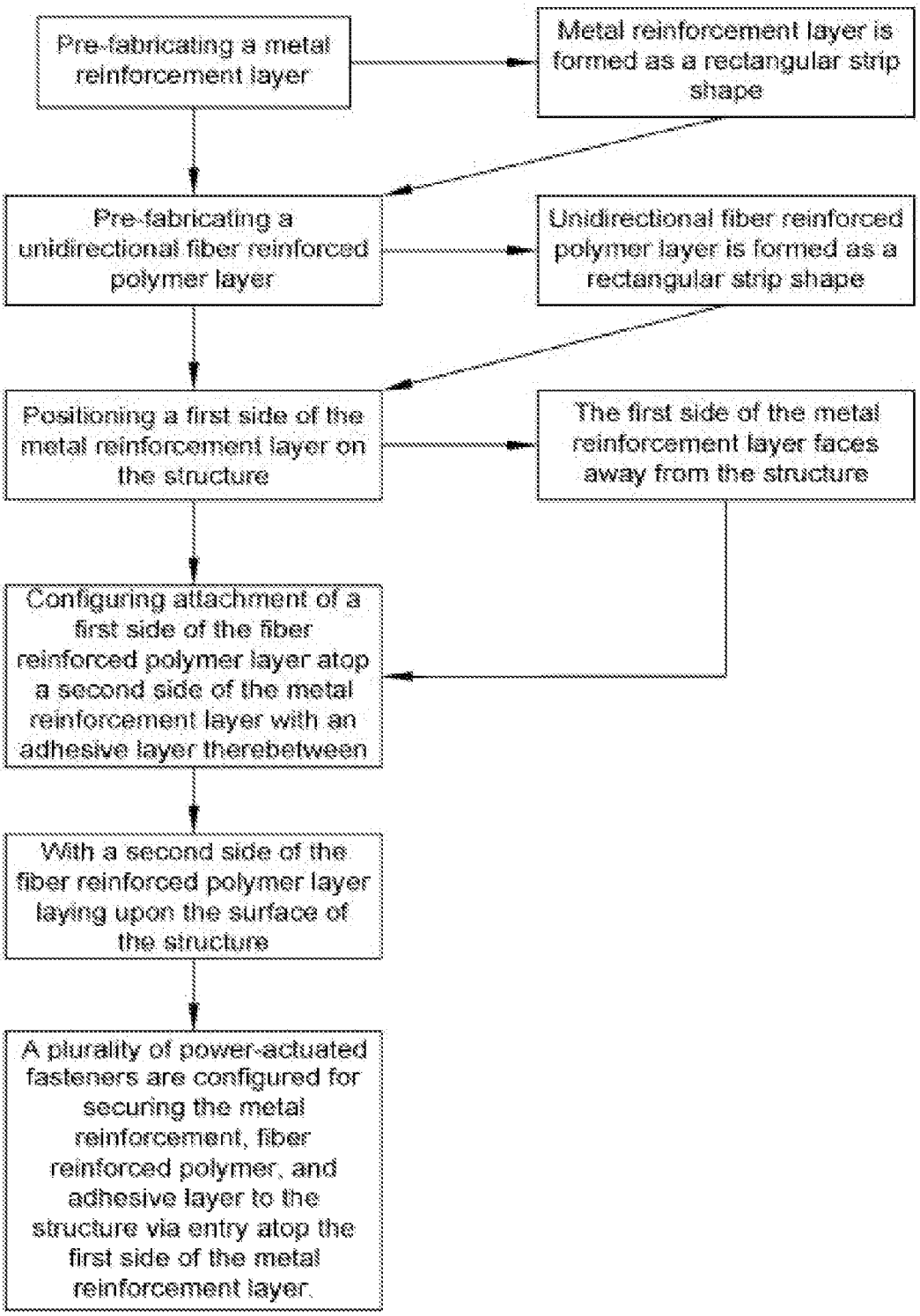
FIG. 9 depicts a flow chart illustrating a method for fabricating an exemplary embodiment of the continuous structural reinforcing device.

FIG. 9 depicts a flow chart illustrating a method of fabricating of an exemplary embodiment of the continuous structural reinforcing device 100 for use on a structure 500. However, the steps referred to on FIG. 9 should not be construed as limiting the scope of the present invention as variations may be employed as explained herein this application, and which includes fabricating device 100 with multiple FRP layers 102 as well as implementing an adhesive layer 200 between the structure 500 and the FRP layer 102.

Various aspects of the present invention are described herein according to embodiments of the invention. While particular forms of the invention have been described, it will also be apparent to those skilled in the art that various modifications can be made without departing from the spirit and scope of the invention. Accordingly, it is not intended that the invention be limited except by the claims.

What is claimed is:

1. A pre-fabricated composite reinforcement device for installation on a structure, comprising:

a metal reinforcement layer;

a fiber reinforced polymer layer;

an adhesive layer configured between the metal and fiber reinforced polymer layer; and a plurality of power-actuated fasteners configured for securing the metal reinforcement, fiber reinforced polymer, and adhesive layer to the structure; and wherein a first side of the metal reinforcement layer is for positioning adjacent to the structure for installation of the fasteners with the first side facing away from the structure, and a second side is configured with the adhesive and fiber reinforced layer across a surface area of the second side of the metal reinforcement layer;

wherein the pre-fabricated reinforcement device comprises a first section and a second section, an end of the first section overlapping an end of the second section to form an overlapping seam, wherein one of the power-actuated fasteners is driven through the overlapping seam into the structure forming a spliced configuration; and wherein the first and second sections are spaced from and not directly contacting the structure.

2. The composite reinforcement device of claim 1, wherein the metal reinforcement layer is further comprised of a light gauge steel.

3. The composite reinforcement device of claim 1, wherein the fiber reinforced polymer layer is further comprised of a unidirectional fiber.

4. The composite reinforcement device of claim 1, wherein the adhesive layer further comprises an epoxy material.

5. The composite reinforcement device of claim 1, wherein the plurality of power-actuated fasteners further comprise concrete nails.

6. The composite reinforcement device of claim 1, wherein the metal reinforcement layer further comprises a plurality of circular markings for installation of the plurality of power-actuated fasteners.

7. The composite reinforcement device of claim 1, further comprising one or more additional fiber reinforced polymer layers configured atop the fiber reinforced polymer layer coupled with the metal reinforcement layer.

8. The composite reinforcement device of claim 1, wherein the metal reinforcement layer and the fiber reinforced polymer layer are rectangular in shape.

9. A pre-fabricated composite reinforcement device for installation on a structure, comprising:

a metal reinforcement layer;

a fiber reinforced polymer layer;

a first adhesive layer configured between the metal reinforced polymer layer and the fiber reinforced polymer layer;

a plurality of power-actuated fasteners configured for securing the metal reinforcement, fiber reinforced polymer, and the first adhesive layer to the structure; and wherein a first side of the metal reinforcement layer is for positioning adjacent to the structure for installation of the fasteners with the first side facing away from the structure; and further wherein a second side of the metal reinforcement layer is configured with the first adhesive layer and the fiber reinforced polymer layer; wherein the pre-fabricated reinforcement device comprises a first section and a second section, an end of the first section overlapping an end of the second section to form an overlapping seam, wherein one of the power-actuated fasteners is driven through the overlapping seam into the structure forming a spliced configuration; and wherein the first and second sections are spaced from and not directly contacting the structure.

10. The composite reinforcement device of claim 9, wherein the first adhesive layer further comprises an epoxy material.

11. The composite reinforcement device of claim 9, wherein the plurality of power-actuated fasteners further comprise concrete screws.

12. The composite reinforcement device of claim 9, wherein the plurality of power-actuated fasteners are installed in a linear configuration along a length of the composite reinforcement device.

13. The composite reinforcement device of claim 9, wherein the plurality of power-actuated fasteners are installed in a staggered alternating configuration along the length of the composite reinforcement device.

14. The composite reinforcement device of claim 9, wherein the metal reinforcement and fiber reinforced polymer layers are elongated rectangle shapes.

15. A method of pre-fabricating a composite reinforcement device for installation on a structure, comprising the steps of:

pre-fabricating a metal reinforcement layer as a rectangular strip shape;

pre-fabricating a unidirectional fiber reinforced polymer layer as a rectangular strip shape;

positioning a first side of the metal reinforcement layer adjacent to the structure with the first side facing away from the structure;

configuring attachment of a first side of the fiber reinforced polymer layer atop a second side of the metal reinforcement layer with an adhesive layer therebetween;

wherein a second side of the fiber reinforced polymer layer is laid adjacent to the structure itself;

wherein a plurality of power-actuated fasteners are configured for securing the metal reinforcement layer, the fiber reinforced polymer layer, and the adhesive layer to the structure via entry on the first side of the metal reinforcement layer;

the pre-fabricated reinforcement device comprises a first section and a second section, an end of the first section overlapping an end of the second section to form an overlapping seam, wherein one of the power-actuated fasteners is driven through the overlapping seam into the structure forming a spliced configuration; and wherein the first and second sections are spaced from and not directly contacting the structure.

16. The method of claim 15, wherein the metal reinforcement and unidirectional fiber reinforced polymer layers are one to twelve inches in width.

17. The method of claim 15, wherein the metal reinforcement, unidirectional fiber reinforced polymer, and adhesive layers are a total of one-eighth inch to one-half inch in height.

18. The method of claim 15, wherein the composite reinforcement device for installation to the structure with the power-actuated fasteners is configured with a power-actuated tool for enhanced effectiveness of installation upon a structure.

* * * * *